United States Patent [19]

Eklund

[11] Patent Number: 4,658,753

[45] Date of Patent: Apr. 21, 1987

[54] ROLL BLADE ASSEMBLY FOR A PAPER COATING MACHINE

[75] Inventor: Dan Eklund, Grankulla, Finland

[73] Assignee: Oy Wärtsilä AB, Värtsilä, Finland

[21] Appl. No.: 749,099

[22] Filed: Jun. 26, 1985

[30] Foreign Application Priority Data

Jun. 29, 1984 [FI] Finland ..... 842625

[51] Int. Cl.[4] ..... B05C 11/04

[52] U.S. Cl. ..... 118/119; 118/118; 15/256.52

[58] Field of Search ..... 118/123, 126, 118, 119, 118/110; 15/256.51, 256.52

[56] References Cited

U.S. PATENT DOCUMENTS

| | | | |
|---|---|---|---|
| 3,817,208 | 6/1974 | Barnscheidt et al. | 118/119 |
| 4,367,120 | 1/1983 | Hendrikz | 15/256.51 X |
| 4,375,202 | 3/1983 | Miller | 118/119 X |

*Primary Examiner*—John P. McIntosh

*Attorney, Agent, or Firm*—Birch, Stewart, Kolasch & Birch

[57] ABSTRACT

A roll blade assembly for a paper coating machine, comprising a frame (5), a support mounted on the frame (5), a blade member (8) mounted on the support (3), a set of mounting accessories (1, 6, 7) for attaching the inner longitudinal end of the blade member (8) to the support (3), a bar unit (9) provided with a rotating metering bar (10) and, attached to the blade member (8), and a pneumatically inflatable loading bag (2) arranged to push the bar unit (9) outwards from the support (3) when the inflation pressure is raised. The blade member (8) is flexible, and the support (3), the bar unit (9), and the blade member (8) form a recess (4) compliant with the loading bag profile and extending in the lateral direction of the blade member (8) over at least 50 percent of the unobstructed blade width. The large inflated bag contact surface makes a more accurate control of the metering bar pressing force possible by directly contacting the blade member.

10 Claims, 2 Drawing Figures

ROLL BLADE ASSEMBLY FOR A PAPER COATING MACHINE

BACKGROUND OF THE INVENTION

The present invention relates to a roll blade assembly for a paper coating machine wherein a loading bag pushes a bar unit outwards.

Such an assembly generally incorporates a frame with an attached support to which a blade member is attached at its other end. The front edge of the blade member is provided with a rotating metering bar. An inflatable loading bag in the assembly has been designed to push the bar unit outwards from the support with increasing inflation pressure so that the rotating bar is pressed against the web that runs over the coating cylinder.

These roll blade or metering bar coating assemblies have gained widening use in paper and cardboard coating machines. The greatest benefits of these coating assemblies are their low sensitivity to contamination in the coating material and long service life as compared to conventional doctor blade coating assemblies. In the latter constructions, the blade must normally be changed 2 to 4 times a day. The greatest disadvantage in doctor blade coating is the difficulty of adjusting the coating material thickness.

In conventional metering bar assemblies, the blade member to which the bar unit with the rotating metering bar is attached at the front edge thereof is stiff compared to a typical doctor blade member. Due to this construction, also the reflow of coating material is easily disturbed.

SUMMARY OF THE INVENTION

The roll blade assembly in accordance with the present invention aims at eliminating the disadvantages present in the conventional solutions mentioned above and proposing a fully new type of a metering bar assmbly.

The present invention is based on using a flexible blade member and a loading bag with a substantial lateral extension and capable of pressing the blade member evenly over a large area to change the position of the bar unit.

More specifically, the assembly in accordance with the invention includes a flexible blade member and a loading bag pressing the blade member evenly over a large area.

By means of the invention, considerable advantages are obtained. Thus

- the stiffness of the assembly is smaller, allowing better control capability for the pressing force,
- better control possibility for the pressing force is also achieved due to the fact that the inflated bag contact surface is large and unobstructed reflow from the coating unit can be insured,
- it is possible to use the new metering bar assembly so that the the slanting angle between the front side of the blade and the the web is small, and
- due to its flexibility, the blade can easily be deformed, allowing the coating unit to be operated by applying the so called narrow angle principle that, in addition to the dynamic pressing force, generates a hydrodynamic pressing force.

The invention will be examined in more detail in the following with the aid of the exemplifying embodiments in accordance with the attached drawing.

DETAILED DESCRIPTION OF THE PREFERRED EMBODIMENT

Figure 1:
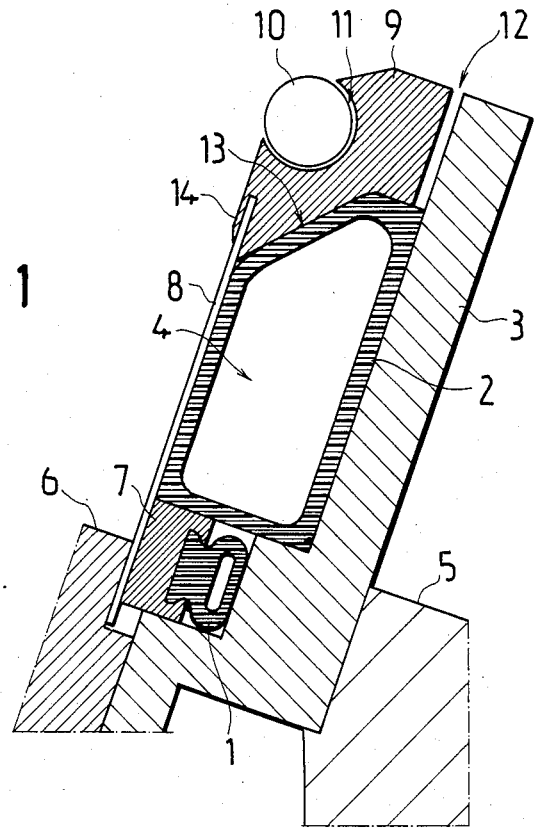
FIG. 1 shows in a partly sectional profile view one embodiment of the roll blade assembly in accordance with the invention.

As shown in FIG. 1, the assembly comprises a frame 5 to which a support 3 is attached. On the front side of the support 3, an end of the blade member 8 is attached by means of mounting accessories. These accessories comprise in the described embodiment a hose or tubular bag 1 having a small diameter, a clamp piece 7, and a counterpiece 6 to clamp the lower end of the blade member 8 between the clamp piece 7 and the counterpiece 6.

The front side of the blade member 8 is provided with a metering bar unit 9, incorporating a rotating metering bar 10. The support 3, the bar unit 9, and the blade member 8 form an approximately trapezoidal recess 4 having a profile corresponding to that of the loading bag 2. The extension of the inflatable bag 2 in the lateral direction of the blade member 8 is at least 50 percent of the unobstructed blade width. The contact surface between the loading bag 2 and blade member 8 is preferably 70 to 80 percent of said unobstructed blade width, the optimum being approximately at 75 percent.

The trapezoidal profile of recess 4 is such that the long side facing the support 3 is substantially longer than the side facing the blade member 8. The corners of the recess 4 facing the frame 5 are approximately at right angles while the corners facing the bar unit 9 are not, making the inner surface 13 of the bar unit 9 operate as an oblique countersurface for the pressing force of loading bag 2, increasing its stability.

The projected extension of the flexible blade member 8 attached to the bar unit 9 at its end 14 dissects the profile of the bar 10 on the side facing the web to be coated.

A slot 12 is provided between the support 3 and the bar unit 9 that, in the uninflated state of the loading bag 2, is almost closed but opens by applying the inflation pressure to the loading bag 2. Since the blade member 8 is manufactured of flexible steel, preferably of so-called doctor blade steel grade, the controlled movement of the metering bar 10 is very stable and easily controllable. The thickness of the flexible blade member 8 is preferably approximately 0.2 to 0.5 mm. The metering bar 10 is so mounted that it extends only slightly (maximally by 1 mm) out from the front side of the blade member 8. The front edge of the bar unit 9 and the front surface of the blade member 8 are butting with each other without discontinuities.

Figure 2:
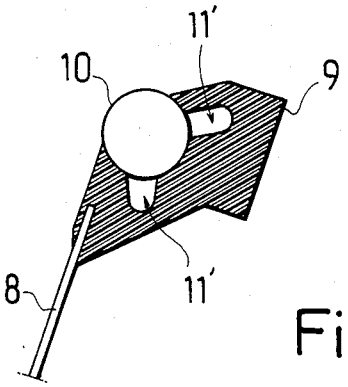
FIG. 2 shows in a partly sectional profile view another embodiment of the roll blade assembly in accordance with the invention.

The alternative embodiment of the invention as shown in FIG. 2 differs from the embodiment shown in FIG. 1 in the way that the bar unit 9 manufactured of rubber is provided with water cooled slots 11'. In this construction the bar 10 wears the rubber member, but thanks to the proper form, the bar unit 9 automatically compensates the wear.

Moreover, it should be mentioned that one additional adventage of the construction in accordance with the invention is that the metering bar assembly can be replaced, when required, without essential alterations in the mounting by an equivalent doctor blade assembly.

What is claimed is:

1. Roll blade assembly for a paper coating machine, comprising a frame (5), a support (3), attached to said frame (5), a blade member (8), attached to said support (3) and having an inner and an outer longitudinal end, mounting means (1, 6, 7) for attaching said inner end of the blade member (8) to said support (3), a bar unit (9) provided with a rotating metering bar (10), attached to said outer end of said blade member (8), a pneumatically inflatable tubular loading bag (2) arranged to push said bar unit (9) outwards from said support (3) at increasing inflation pressure, said blade member (8) is flexible, said support (3), said bar unit (9), and said blade member (8) define a recess (4) having a profile substantially corresponding to that of said loading bag (2) and extending in the lateral direction of said blade member (8) at least by 50 percent of the unobstructed width of said blade member (8) and, said loading bag (2) being located in said recess (4) and contacting said blade member (8).

2. Assembly as claimed in claim 1, characterized in that the projected extension of said outer end (14) of said flexible blade member (8), attached to said bar unit (9), intersects said bar (10) profile on the side facing the web to be coated.

3. Assembly as claimed in claim 2, characterized in that the contact area width with which said loading bag (2) contacts said blade member (8) is 70 to 80 percent, preferably approximately 75 percent, of the unobstructed blade width.

4. Assembly as claimed in claim 2, characterized in that said profile of said recess (4) is at least approximately trapezoidal so that the long side facing said frame (5) is substantially longer than the side facing said blade member (8) and the angles thereof facing said frame (5) are approximately right angles.

5. Assembly as claimed in claim 2, characterized in that said support (3) and said bar unit (9) form a slot (12) that is almost closed in the uniflated state of said loading bag (2).

6. Assembly as claimed in claim 1, characterized in that the contact area width with which said loading bag (2) contacts said blade member (8) is 70 to 80 percent, preferably approximately 75 percent, of the unobstructed blade width.

7. Assembly as claimed in claim 1, characterized in that said recess (4) is at least approximately trapezoidal so that the long side facing said frame (5) is substantially longer than the side facing said blade member (8) and the angles thereof facing said frame (5) are approximately right angles.

8. Assembly as claimed in claim 1, characterized in that said support (3) and said bar unit (9) form a slot (12) that is almost closed in the uninflated state of said loading bag (2).

9. Assembly as claimed in claim 1, characterized in that said blade member (8) is manufactured of flexible steel.

10. Assembly as claimed in claim 9, characterized in that said blade member (8) is the doctor blade of a conventional doctor blade assembly.

* * * * *